US011326611B1

(12) United States Patent
Huang

(10) Patent No.: US 11,326,611 B1
(45) Date of Patent: May 10, 2022

(54) PORTABLE MOBILE FAN

(71) Applicant: Xiaosheng Huang, Jiujiang (CN)

(72) Inventor: Xiaosheng Huang, Jiujiang (CN)

( * ) Notice: Subject to any disclaimer, the term of this patent is extended or adjusted under 35 U.S.C. 154(b) by 0 days.

(21) Appl. No.: 17/579,503

(22) Filed: Jan. 19, 2022

(30) Foreign Application Priority Data

Jan. 4, 2022 (CN) ..... 202220014451.0

(51) Int. Cl.
*F04D 25/08* (2006.01)
*F04D 25/06* (2006.01)
*F04D 29/62* (2006.01)
*F04D 29/42* (2006.01)

(52) U.S. Cl.
CPC ..... *F04D 25/084* (2013.01); *F04D 25/0673* (2013.01); *F04D 29/4226* (2013.01); *F04D 29/624* (2013.01)

(58) Field of Classification Search
CPC ..... F04D 25/0673; F04D 25/084
See application file for complete search history.

(56) References Cited

U.S. PATENT DOCUMENTS 6,530,751 B1 * 3/2003 Song ..... F04D 25/084 417/423.1
8,070,434 B2 * 12/2011 Sun ..... F04D 29/601 415/214.1
D923,773 S * 6/2021 Wang ..... D23/382
2007/0170320 A1 * 7/2007 Sun ..... F04D 25/08 248/177.1

FOREIGN PATENT DOCUMENTS

CN 213331641 U 6/2021
CN 213684587 U 7/2021
CN 213981265 U 8/2021
DE 202014100140 * 4/2014 ..... F04D 25/084
WO WO-2009065629 A1 * 5/2009 ..... A61L 9/012

OTHER PUBLICATIONS

English translation of WO 2009065629 (Year: 2009).*
English translation of DE 202014100140 (Year: 2014).*

* cited by examiner

*Primary Examiner* — Eldon T Brockman
*Assistant Examiner* — Brian O Peters
(74) *Attorney, Agent, or Firm* — Brandon V. Zuniga; Stephen Y. Liu; Carstens & Cahoon, LLP

(57) ABSTRACT

The present disclosure discloses a portable mobile fan, comprising a fan body and fixing devices, the fan body comprises a fan shell, a windshield cover, an impeller, a motor, a circuit board and a switch button; which has large air output, has a fan body with relative position changed by adjusting fixing brackets, can be fixed on different objects, and has strong practicability.

8 Claims, 6 Drawing Sheets

PORTABLE MOBILE FAN

CROSS-REFERENCE TO RELATED APPLICATIONS

The application claims priority to Chinese patent application No. 202220014451.0, filed on Jan. 4, 2022, the entire contents of which are incorporated herein by reference.

TECHNICAL FIELD

The present disclosure relates to the technical field of fans, in particular to a portable mobile fan.

BACKGROUND

With the continuous progress of scientific level and the continuous development of society, fans have become an important electrical appliance in the life of people in summer. With the continuous updating and development of technology, small fans are popular with consumers because of portability and low price. However, the existing small fans still have some defects, such as inconvenient fixation. The existing fixing bracket does not have the characteristics of deformation, and has a fixed structure, so that planar and curved fixing places cannot be taken into account at the same time; the existing fixing bracket can only be fixed on a flat surface or a curved surface and cannot be transformed into different suitable fixing shapes according to different use circumstances, thereby causing great limitation, inconvenient assembly and disassembly, poor practicability and other problems.

Therefore, a portable mobile fan is urgently needed in the market to solve the above problems.

SUMMARY

In view of the defects in the prior art, the present disclosure provides a portable mobile fan, which has fixing brackets adjustable in position relative to a fan body; and the fixing brackets can be deformed to be fixed on different objects, thereby realizing strong practicability.

To achieve the above purpose, the following technical solution is adopted by the present disclosure:

A portable mobile fan, comprising a fan body and fixing devices, wherein the fan body comprises a fan shell, a windshield cover, an impeller, a motor, a circuit board and a switch button; the fixing devices are connected with the fan shell; the windshield cover is arranged inside the fan shell; an accommodating cavity is formed between the windshield cover and the fan shell; the impeller is arranged inside the accommodating cavity; the impeller is connected with the motor; an air inlet is formed at one side of the fan shell; an air outlet is formed at the other side of the fan shell; the windshield cover, the air inlet and the air outlet are communicated with one another; the external air enters the accommodating cavity through the air inlet; and the impeller is driven by the motor to accelerate the external air entering the accommodating cavity, so that the external air inside the accommodating cavity is discharged from the air outlet.

As a further elaboration of the above technical solution:

In the above technical solution, wherein the fan shell comprises an upper fan shell and a lower fan shell; the upper fan shell covers an upper end of the lower fan shell; a windshield cover fixing part is arranged on the lower fan shell; and the windshield cover is fixed at the windshield cover fixing part on the lower fan shell by screws to form the accommodating cavity.

In the above technical solution, wherein the air inlet is formed at the bottom of the lower fan shell; an air outlet placing part is arranged at the joint of the upper fan shell and the lower fan shell; and the air outlet is fixed at the air outlet placing part.

In the above technical solution, wherein a battery placing part is arranged at the upper end of the windshield cover, and is used for placing batteries, which provide a power source for the motor.

In the above technical solution, wherein the impeller is of a spiral structure; a rotating shaft of the motor is connected with the impeller; the motor is electrically connected with the battery placing part; the batteries are electrically connected with the motor through the battery placing part; and the batteries drive the impeller to rotate by driving the rotating shaft of the motor to rotate, so that the external air entering the accommodating cavity from the air inlet is accelerated and discharged out of the accommodating cavity from the air outlet.

In the above technical solution, wherein a switch button placing part is arranged between the upper fan shell and the lower fan shell; one end of the switch button is arranged at the switch button placing part, and the other end of the switch button is electrically connected with the circuit board; the circuit board is electrically connected with the motor and the batteries respectively; and the switch button is used for controlling the circuit board to control the start and stop of the motor and the gear adjustment of the motor.

In the above technical solution, wherein the fixing devices refer to three deformable fixing brackets; a connecting device is arranged at the lower end of the lower fan shell; a rotating device matched with the connecting device is arranged at the upper end of each fixing bracket; and the fixing brackets are rotatably arranged at the connecting device through the rotating devices.

In the above technical solution, wherein each rotating device comprises a rotating head and a fixing groove; the rotating head is arranged at the upper end of the fixing groove; each fixing bracket comprises a deformable supporting rod and a cladding rod; the upper end of the cladding rod is inserted into the fixing groove, to be fixed with the rotating device; a supporting rod accommodating region is formed between the cladding rod and the fixing groove; a fixing piece is arranged inside the fixing groove; and the upper end of the supporting rod is fixed at the fixing piece, so that the supporting rod is located in the supporting rod accommodating region.

In the above technical solution, wherein the outer surface of the cladding rod is provided with anti-slip ridges; the supporting rod is an aluminum alloy supporting rod; and the cladding rod is a silica gel cladding rod.

In the above technical solution, wherein a connecting part is arranged at the lower end of the connecting device; and the rotating head is rotatably arranged at the connecting part.

Compared with the prior art, the present disclosure specifically has the apparent advantages and beneficial effects of novel structure and reasonable design; and the deformable fixing brackets are adopted, so that the portable mobile fan provided by the present disclosure can be fixed on the desktop, can also be fixed at a column-like fixing part (such as a motorcycle, a locomobile or a baby stroller), and can also be deformed and bent into a mobile phone fixing bracket, thereby being wide in application range, unlikely to be broken, good in bending property, convenient to be disassembled and assembled, portable, and strong in practicability.

To more clearly elaborate structural features and technical means of the present disclosure and the achieved specific purposes and functions, the present disclosure will be further described in detail with reference to the accompanying drawings and specific embodiments.

DETAILED DESCRIPTION OF THE EMBODIMENTS

Figure 1:
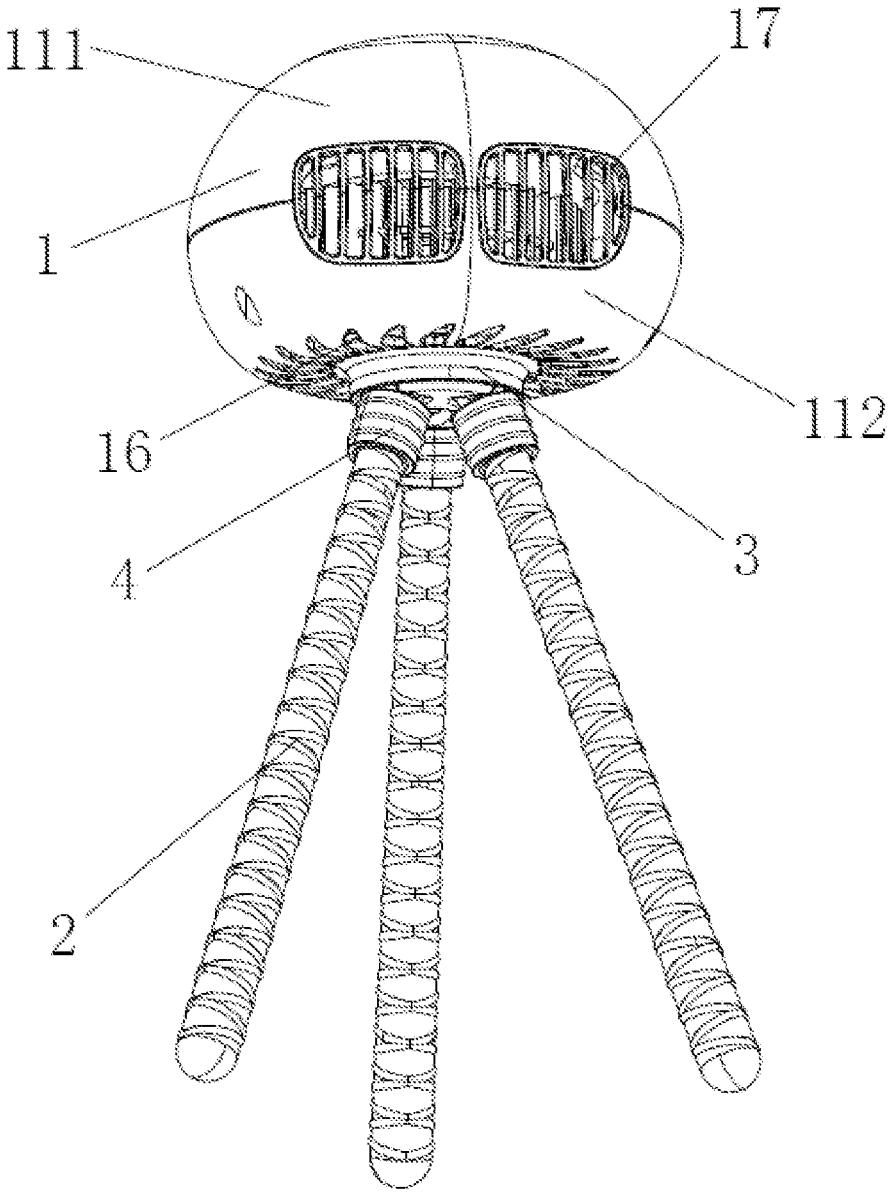
FIG. 1 is a schematic diagram of an overall structure of the present disclosure.
Figure 2:
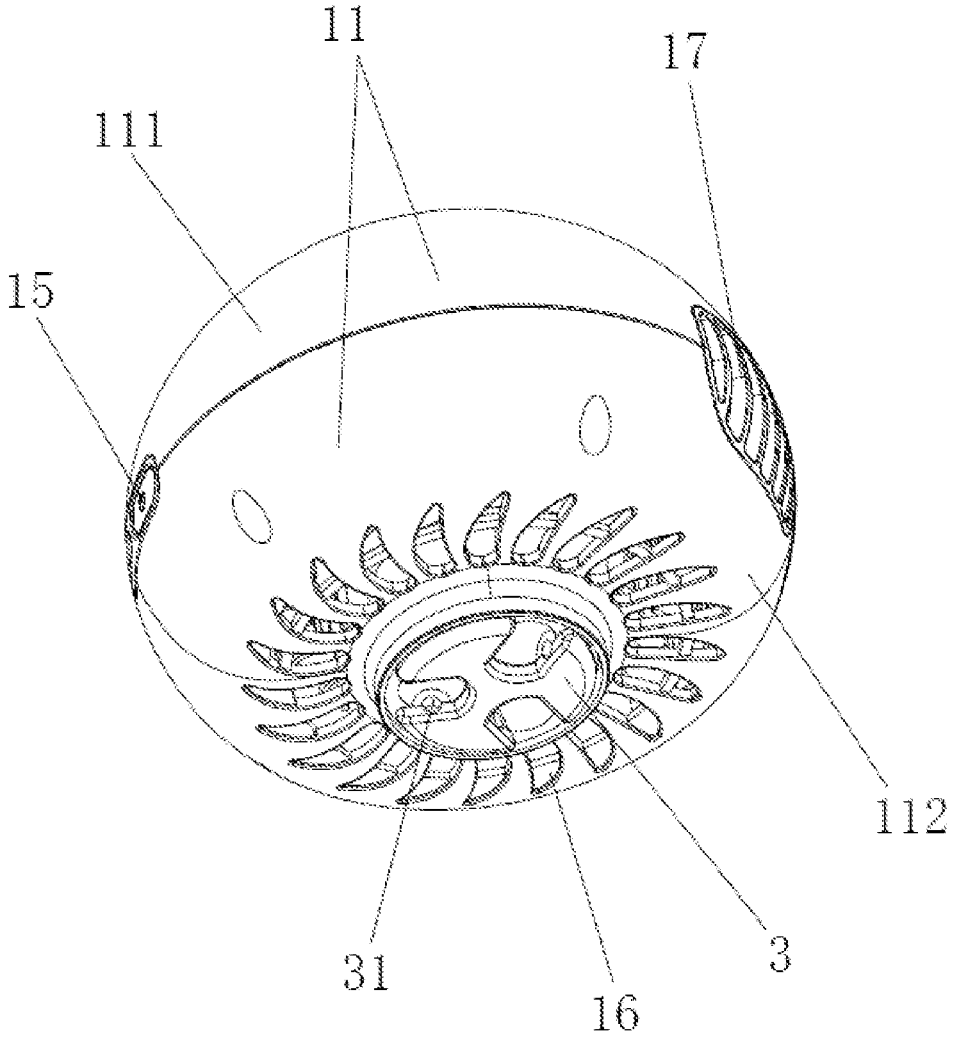
FIG. 2 is a schematic diagram of the overall structure of a fan body.
Figure 3:
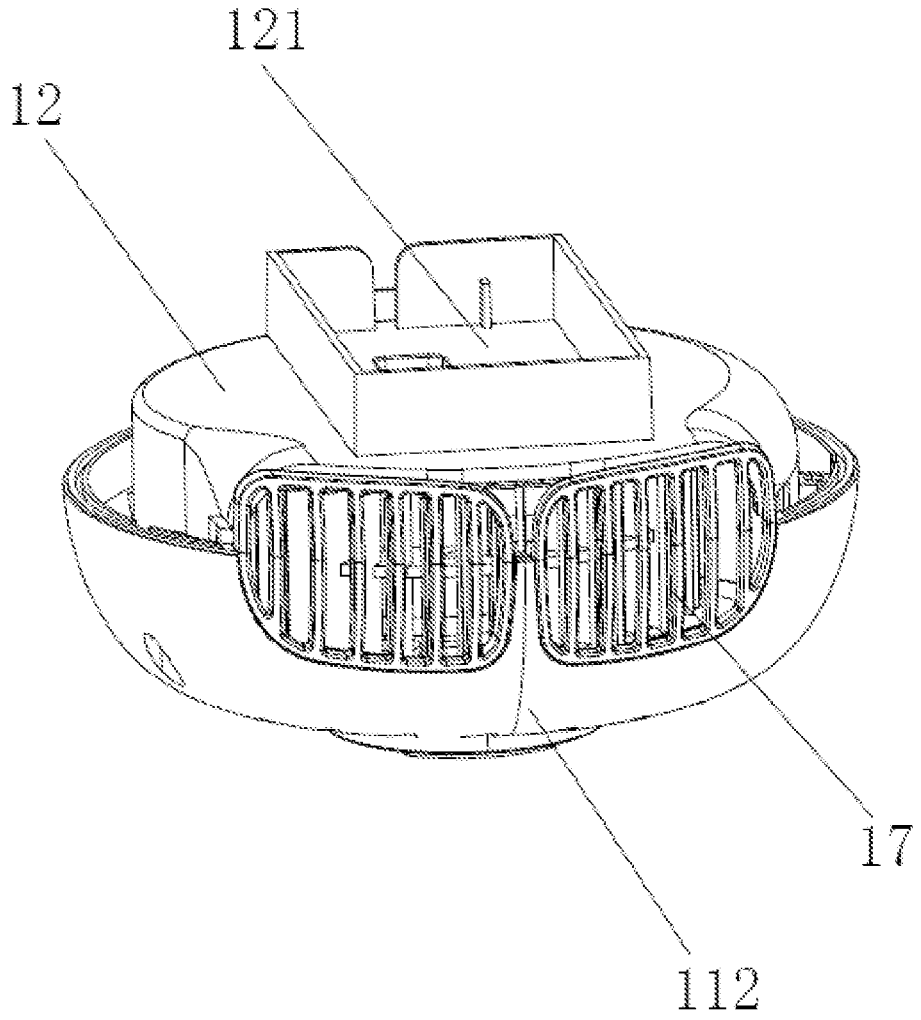
FIG. 3 is a structural schematic diagram of a lower fan shell and a windshield cover.
Figure 4:
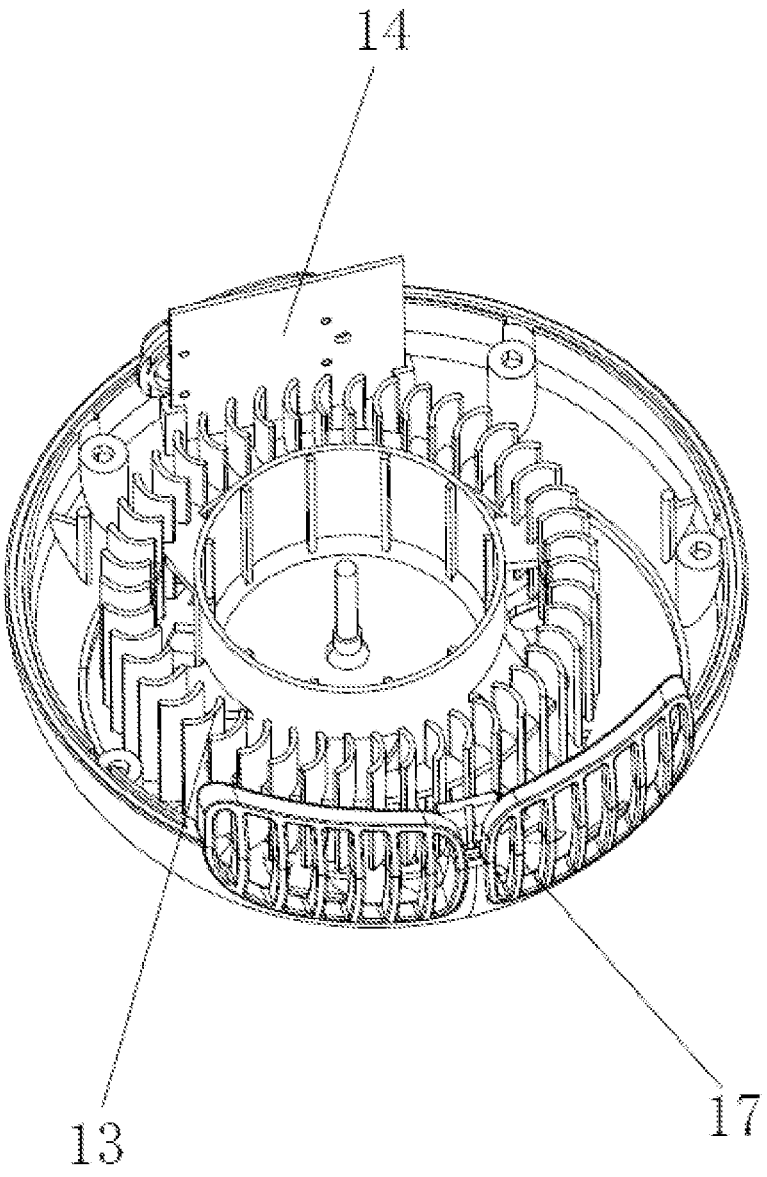
FIG. 4 is a structural schematic diagram of the lower fan shell and an impeller.
Figure 5:
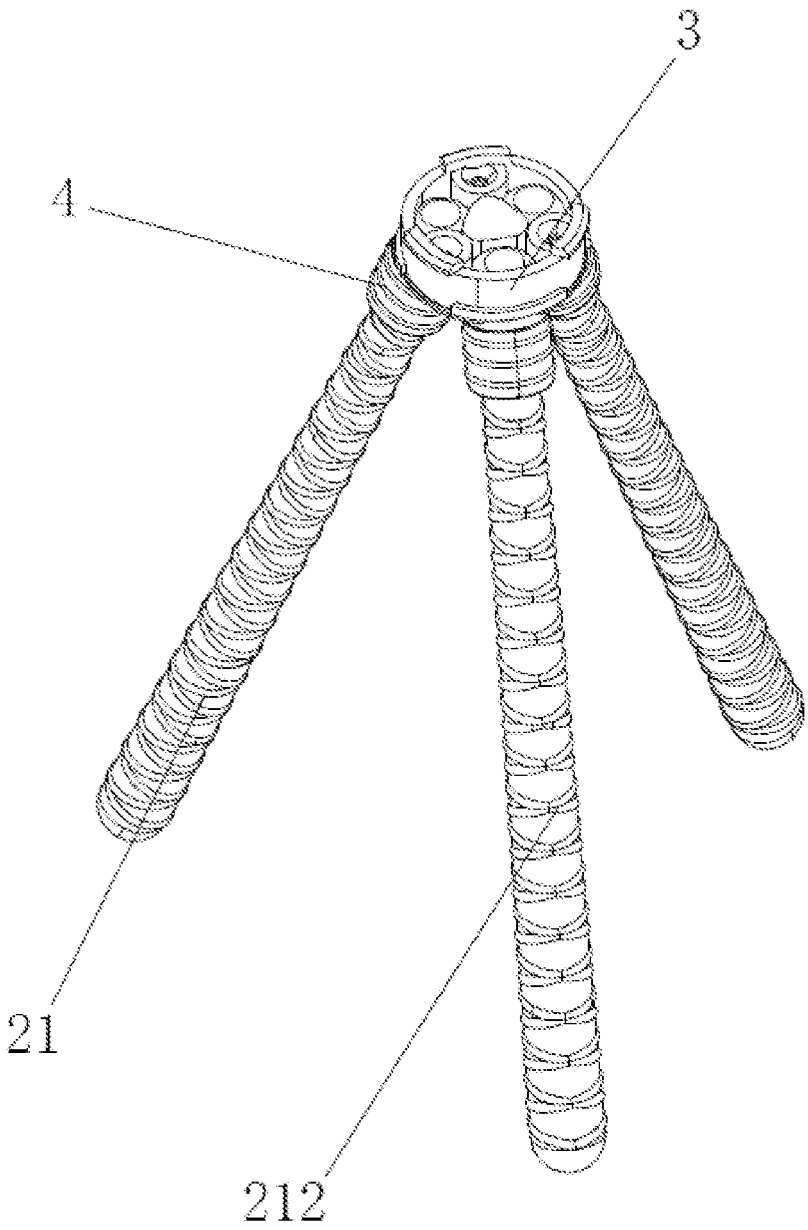
FIG. 5 is a structural schematic diagram of a fixing bracket, a connecting device and a rotating device.
Figure 6:
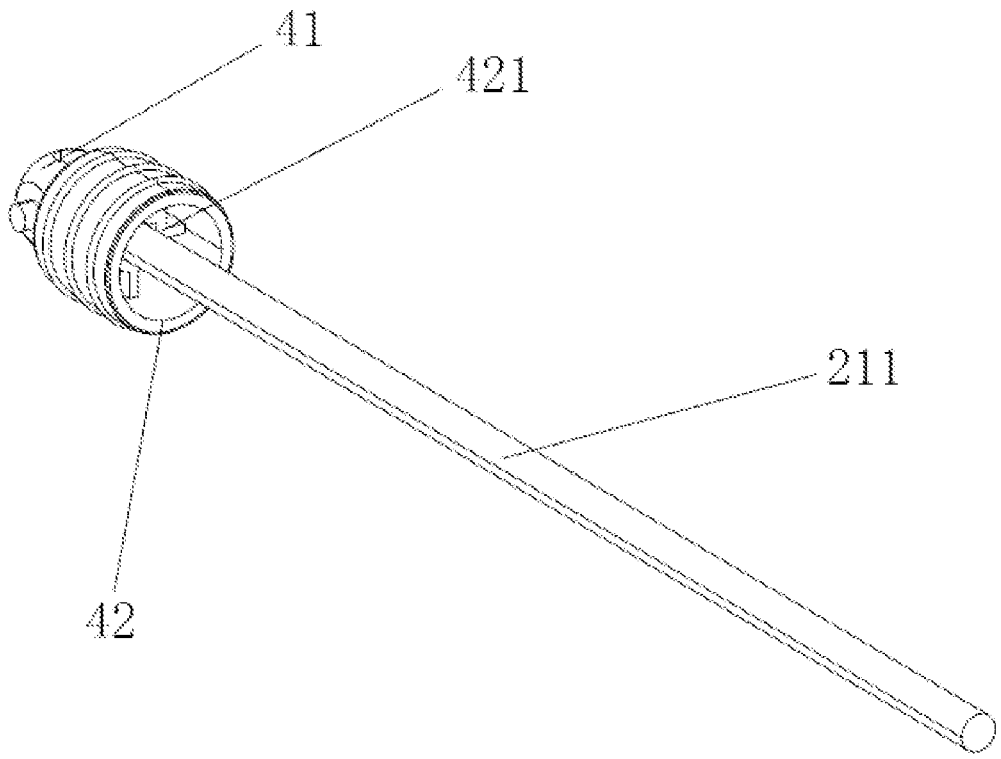
FIG. 6 is a schematic diagram of a partial structure of the fixing bracket.

As shown in FIGS. 1-6, a portable mobile fan comprises a fan body 1 and fixing devices 2, wherein the fan body 1 comprises a fan shell 11, a windshield cover 12, an impeller 13, a motor, a circuit board 14 and a switch button 15; the fixing devices 2 are connected with the fan shell 11; the windshield cover 12 is arranged inside the fan shell 11; an accommodating cavity is formed between the windshield cover 12 and the fan shell 11; the impeller 13 is arranged inside an accommodating cavity; the impeller 13 is connected with the motor; an air inlet 16 is formed at one side of the fan shell 11; an air outlet 17 is formed at the other side of the fan shell 11; the windshield cover 12, the air inlet 16 and the air outlet 17 are communicated with one another; the external air enters the accommodating cavity through the air inlet 16; and the impeller 13 is driven by the motor to accelerate the external air entering the accommodating cavity, so that the external air inside the accommodating cavity is discharged from the air outlet 17.

As a further improvement of the present disclosure, the fan shell 11 comprises an upper fan shell 111 and a lower fan shell 112; the upper fan shell 111 covers an upper end of the lower fan shell 112; a windshield cover fixing part is arranged on the lower fan shell 112; and the windshield cover 12 is fixed at the windshield cover fixing part on the lower fan shell 112 by screws to form the accommodating cavity.

As a further improvement of the present disclosure, the air inlet 16 is formed at the bottom of the lower fan shell 112; an air outlet placing part is arranged at the joint of the upper fan shell 111 and the lower fan shell 112; and the air outlet 17 is fixed at the air outlet placing part.

As a further improvement of the present disclosure, a battery placing part 121 is arranged at the upper end of the windshield cover 12, and is used for placing batteries, which provide a power source for the motor.

As a further improvement of the present disclosure, the impeller 13 is of a spiral structure; a rotating shaft of the motor is connected with the impeller 13; the motor is electrically connected with the battery placing part 121; the batteries are electrically connected with the motor through the battery placing part 121; and the batteries drive the impeller 13 to rotate by driving the rotating shaft of the motor to rotate, so that the external air entering the accommodating cavity from the air inlet 16 is accelerated and discharged out of the accommodating cavity from the air outlet 17.

As a further improvement of the present disclosure, a switch button placing part is arranged between the upper fan shell 111 and the lower fan shell 112; one end of the switch button 15 is arranged at the switch button placing part, and the other end of the switch button 15 is electrically connected with the circuit board 14; the circuit board 14 is electrically connected with the motor and the batteries respectively; and the switch button 15 is used for controlling the circuit board 14 to control the start and stop of the motor and the gear adjustment of the motor.

As a further improvement of the present disclosure, the fixing devices 2 refer to three deformable fixing brackets 21; a connecting device 3 is arranged at the lower end of the lower fan shell 112; a rotating device 4 matched with the connecting device 3 is arranged at the upper end of each fixing bracket 21; and the fixing brackets 21 are rotatably arranged at the connecting device 3 through the rotating devices 4.

As a further improvement of the present disclosure, each rotating device 4 comprises a rotating head 41 and a fixing groove 42; the rotating head 41 is arranged at the upper end of the fixing groove 42; each fixing bracket 21 comprises a deformable supporting rod 211 and a cladding rod 212; the upper end of the cladding rod 212 is inserted into the fixing groove 42, to be fixed with the rotating device 4; a supporting rod accommodating region is formed between the cladding rod 212 and the fixing groove 42; a fixing piece 421 is arranged inside the fixing groove 42; and the upper end of the supporting rod 211 is fixed at the fixing piece 421, so that the supporting rod 211 is located in the supporting rod accommodating region.

As a further improvement of the present disclosure, the outer surface of the cladding rod 212 is provided with anti-slip ridges; the supporting rod 211 is an aluminum alloy supporting rod 211; and the cladding rod 212 is a silica gel cladding rod 212.

As a further improvement of the present disclosure, a connecting part 31 is arranged at the lower end of the connecting device 3; and the rotating head 41 is rotatably arranged at the connecting part 31.

What is claimed is:

1. A portable mobile fan, comprising a fan body and fixing devices, wherein the fan body comprises a fan shell, a windshield cover, an impeller, a motor, a circuit board and a switch button; the fixing devices are connected with the fan shell; the windshield cover is arranged inside the fan shell; an accommodating cavity is formed between the windshield cover and the fan shell; the impeller is arranged inside the accommodating cavity; the impeller is connected with the motor; an air inlet is formed at one side of the fan shell; an air outlet is formed at the other side of the fan shell; the windshield cover, the air inlet and the air outlet are communicated with one another; the external air enters the accommodating cavity through the air inlet; the impeller is driven by the motor to accelerate the external air entering the accommodating cavity, so that the external air inside the accommodating cavity is discharged from the air outlet; wherein the fan shell comprises an upper fan shell and a lower fan shell; the upper fan shell covers an upper end of the lower fan shell; a windshield cover fixing part is arranged on the lower fan shell; the windshield cover is fixed at the windshield cover fixing part on the lower fan shell by screws to form the accommodating cavity; wherein the air inlet is formed at the bottom of the lower fan shell; an air outlet placing part is arranged at the joint of the upper fan shell and the lower fan shell; and the air outlet is fixed at the air outlet placing part.

2. A portable mobile fan, comprising a fan body and fixing devices, wherein the fan body comprises a fan shell, a windshield cover, an impeller, a motor, a circuit board and a switch button; the fixing devices are connected with the fan shell; the windshield cover is arranged inside the fan shell; an accommodating cavity is formed between the windshield cover and the fan shell; the impeller is arranged inside the accommodating cavity; the impeller is connected with the motor; an air inlet is formed at one side of the fan shell; an air outlet is formed at the other side of the fan shell; the windshield cover, the air inlet and the air outlet are communicated with one another; the external air enters the accommodating cavity through the air inlet; the impeller is driven by the motor to accelerate the external air entering the accommodating cavity, so that the external air inside the accommodating cavity is discharged from the air outlet; wherein the fan shell comprises an upper fan shell and a lower fan shell; the upper fan shell covers an upper end of the lower fan shell; a windshield cover fixing part is arranged on the lower fan shell; the windshield cover is fixed at the windshield cover fixing part on the lower fan shell by screws to form the accommodating cavity; wherein a battery placing part is arranged at the upper end of the windshield cover, and is used for placing batteries, which provide a power source for the motor.

3. The portable mobile fan of claim 2, wherein the impeller is of a spiral structure; a rotating shaft of the motor is connected with the impeller; the motor is electrically connected with the battery placing part; the batteries are electrically connected with the motor through the battery placing part; and the batteries drive the impeller to rotate by driving the rotating shaft of the motor to rotate, so that the external air entering the accommodating cavity from the air inlet is accelerated and discharged out of the accommodating cavity from the air outlet.

4. The portable mobile fan of claim 3, wherein a switch button placing part is arranged between the upper fan shell and the lower fan shell; one end of the switch button is arranged at the switch button placing part, and the other end of the switch button is electrically connected with the circuit board; the circuit board is electrically connected with the motor and the batteries respectively; and the switch button is used for controlling the circuit board to control the start and stop of the motor and the gear adjustment of the motor.

5. A portable mobile fan, comprising a fan body and fixing devices, wherein the fan body comprises a fan shell, a windshield cover, an impeller, a motor, a circuit board and a switch button; the fixing devices are connected with the fan shell; the windshield cover is arranged inside the fan shell; an accommodating cavity is formed between the windshield cover and the fan shell; the impeller is arranged inside the accommodating cavity; the impeller is connected with the motor; an air inlet is formed at one side of the fan shell; an air outlet is formed at the other side of the fan shell; the windshield cover, the air inlet and the air outlet are communicated with one another; the external air enters the accommodating cavity through the air inlet; the impeller is driven by the motor to accelerate the external air entering the accommodating cavity, so that the external air inside the accommodating cavity is discharged from the air outlet; wherein the fan shell comprises an upper fan shell and a lower fan shell; the upper fan shell covers an upper end of the lower fan shell; a windshield cover fixing part is arranged on the lower fan shell; the windshield cover is fixed at the windshield cover fixing part on the lower fan shell by screws to form the accommodating cavity; wherein the fixing devices refer to three deformable fixing brackets; a connecting device is arranged at the lower end of the lower fan shell; a rotating device matched with the connecting device is arranged at the upper end of each fixing bracket; and the fixing brackets are rotatably arranged at the connecting device through the rotating devices.

6. The portable mobile fan of claim 5, wherein each rotating device comprises a rotating head and a fixing groove; the rotating head is arranged at the upper end of the fixing groove; each fixing bracket comprises a deformable supporting rod and a cladding rod; the upper end of the cladding rod is inserted into the fixing groove, to be fixed with the rotating device; a supporting rod accommodating region is formed between the cladding rod and the fixing groove; a fixing piece is arranged inside the fixing groove; and the upper end of the supporting rod is fixed at the fixing piece, so that the supporting rod is located in the supporting rod accommodating region.

7. The portable mobile fan of claim 6, wherein the outer surface of the cladding rod is provided with anti-slip ridges; the supporting rod is an aluminum alloy supporting rod; and the cladding rod is a silica gel cladding rod.

8. The portable mobile fan of claim 6, wherein a connecting part is arranged at the lower end of the connecting device; and the rotating head is rotatably arranged at the connecting part.

* * * * *